US007391997B2

(12) United States Patent
Ikeda

(10) Patent No.: US 7,391,997 B2
(45) Date of Patent: Jun. 24, 2008

(54) DEVELOPER APPARATUS AND IMAGE FORMING APPARATUS HAVING AN AUXILIARY COLLECTING MEMBER PROVIDED IN A GAP BETWEEN FEED BLADES

(75) Inventor: Takashi Ikeda, Tagata-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 343 days.

(21) Appl. No.: 11/206,173

(22) Filed: Aug. 18, 2005

(65) Prior Publication Data

US 2007/0041748 A1 Feb. 22, 2007

(51) Int. Cl.
*G03G 15/08* (2006.01)

(52) U.S. Cl. ..... 399/253; 399/254; 399/256

(58) Field of Classification Search ..... 399/98, 399/99, 253–256, 258, 358, 359
See application file for complete search history.

(56) References Cited

U.S. PATENT DOCUMENTS 5,495,320 A * 2/1996 Araki et al. ..... 399/256
2005/0111883 A1 5/2005 Amano et al.
2005/0207793 A1* 9/2005 Ikeda et al. ..... 399/254

FOREIGN PATENT DOCUMENTS

JP 10-260583 A 9/1998

OTHER PUBLICATIONS

U.S. Appl. No. 10/802,046, filed Mar. 17, 2004, Ikeda et al.
U.S. Appl. No. 10/802,047, filed Mar. 17, 2004, Ikeda et al.

* cited by examiner

*Primary Examiner*—David M. Gray
*Assistant Examiner*—Laura K Roth
(74) *Attorney, Agent, or Firm*—Foley & Lardner LLP

(57) ABSTRACT

An image forming apparatus collects toner remaining on a photoconductive drum after a toner image is transferred to paper, and collects the impurities (paper dust) included in the toner collected in an image forming apparatus which reuses the collected toner by a mixer provided in a developer container. An auxiliary collecting member is provided in a gap between first feed blades and second feed blades in an impurity collector.

16 Claims, 8 Drawing Sheets

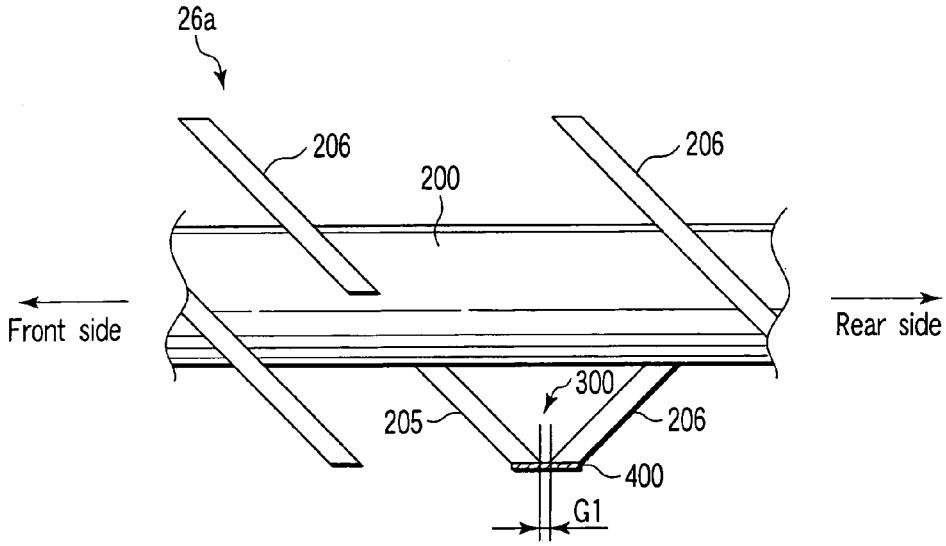
FIG. 8
| Gap G1 (mm) | 0 | 0.1 | 0.25 | ··· | 0.5 |
|---|---|---|---|---|---|
| Paper dust save | 1 | 0.75 | 0.5 | ··· | 0 |
| Dust fog pape number | 135k sheets | 90k sheets | 60k sheets | ··· | 30k sheets |
| Image forming | ○ | ○ | △ | × | × |
FIG. 9
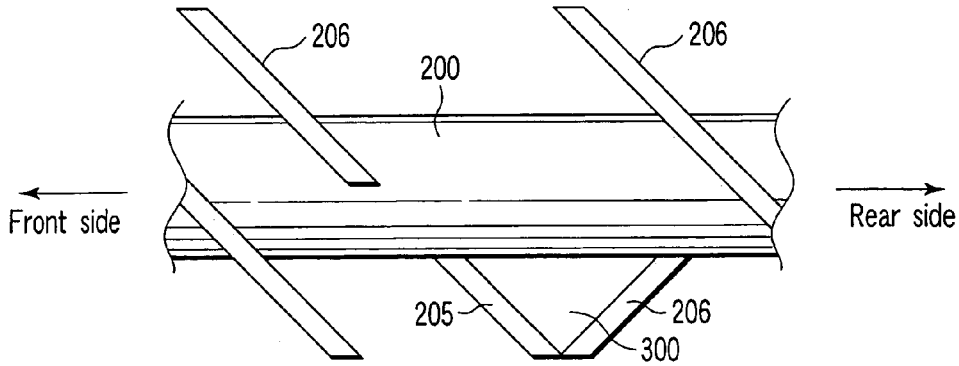
FIG. 10

DEVELOPER APPARATUS AND IMAGE FORMING APPARATUS HAVING AN AUXILIARY COLLECTING MEMBER PROVIDED IN A GAP BETWEEN FEED BLADES

BACKGROUND OF THE INVENTION

1. Field of the Invention

The present invention relates to an image forming apparatus for forming an image using developer, and a developing unit incorporated in the image forming apparatus for containing the developer.

2. Description of the Related Art

An image forming apparatus for forming an image using developer including, for example, toner forms an electrostatic latent image on a photoconductive drum as an image carrier, develops the static image in a developing unit, transfers the obtained toner image onto a paper sheet in a transfer unit, and fixes the image on the paper sheet in a fixing unit.

There is a known image forming apparatus, which has a cleaning unit to remove toner remaining on the photoconductive drum after transfer of a toner image onto the paper sheet, and reuses the collected toner (hereinafter called recycled toner).

For example, there is a toner recycling mechanism, which feeds recycled toner collected by a collecting mixer provided in a cleaning unit by means of a coupling mixer connected with the cleaning unit and developing unit, and returns the toner directly to the developing unit.

In this case, the collected recycled toner is always supplied to the developing unit while the collecting mixer and coupling mixer are operating.

The recycled toner for reuse includes toner particles peeled off partially a peculiar external additive adhered with an external additive peeled off from another toner, or mixed with paper dust. The paper dust adheres to a paper sheet as a transfer medium, and includes a long pulp fiber or cellulose fiber. Thus, when the recycled toner is put in a developing unit, the paper dust put in together with the toner is fed to a developing position and causes stained development. If the paper dust is clogged in developer blades controlling the amount of developer when the developer is supplied from a developing unit to a photoconductor, the developer is not evenly supplied to the photoconductor.

BRIEF SUMMARY OF THE INVENTION

According to an aspect of the present invention, there is provided a developing unit comprising:

a developer container to contain developer;

a mixer which is composed of a rotary shaft member held rotatably at a predetermined position of the developer container, first feed blades formed at predetermined positions of the rotary shaft member to feed the developer in a first direction, and second feed blades formed at predetermined positions of the rotary shaft member to feed the developer in a direction different from the first direction; and an impurity collector which is formed between the first feed blades and second feed blades faced to each other in the axial direction of the rotary shaft member, and collects impurities mixed in the developer fed by the first feed blades and second feed blades.

According to another aspect of the present invention, there is provided an image forming apparatus comprising:

an image carrier to hold electrostatically a developer image formed by developer;

a developer container to contain developer;

a mixer which is composed of a rotary shaft member held rotatably at a predetermined position of the developer container, first feed blades formed at predetermined positions of the rotary shaft member to feed the developer in a first direction, and second feed blades formed at predetermined positions of the rotary shaft member to feed the developer in a direction different from the first direction; and an impurity collector which is formed between the first feed blades and second feed blades faced to each other in the axial direction of the rotary shaft member, and collects impurities mixed in the developer fed by the first feed blades and second feed blades.

According to further aspect of the present invention, there is provided an image forming apparatus comprising:

an image carrying means for holding electrostatically a developer image formed by developer;

a developer containing means for containing developer;

a stirring means for having a rotary shaft member held rotatably at predetermined positions of the developer containing means, first feed blades formed at a predetermined position of the rotary shaft member to feed the developer in a first direction, and second feed blades formed at predetermined positions of the rotary shaft member to feed the developer in a direction different from the first direction; and an impurity collecting means for collecting impurities mixed in the developer fed by the first feed blades and second feed blades, said means formed between the first feed blades and second feed blades faced to each other in the axial direction of the rotary shaft member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 8 is a schematic diagram showing an example of the impurity collector shown in FIGS. 6 and 7;

FIG. 9 is a table showing the ratio of paper dust amount for different sized gaps, according to an embodiment of the invention; and FIG. 10 is a view showing zero gap in an impurity collector according to an embodiment of the invention.

DETAILED DESCRIPTION OF THE INVENTION

An example of an image forming apparatus according to an embodiment of the present invention will be explained hereinafter with reference to the accompanying drawings.

Figure 1:
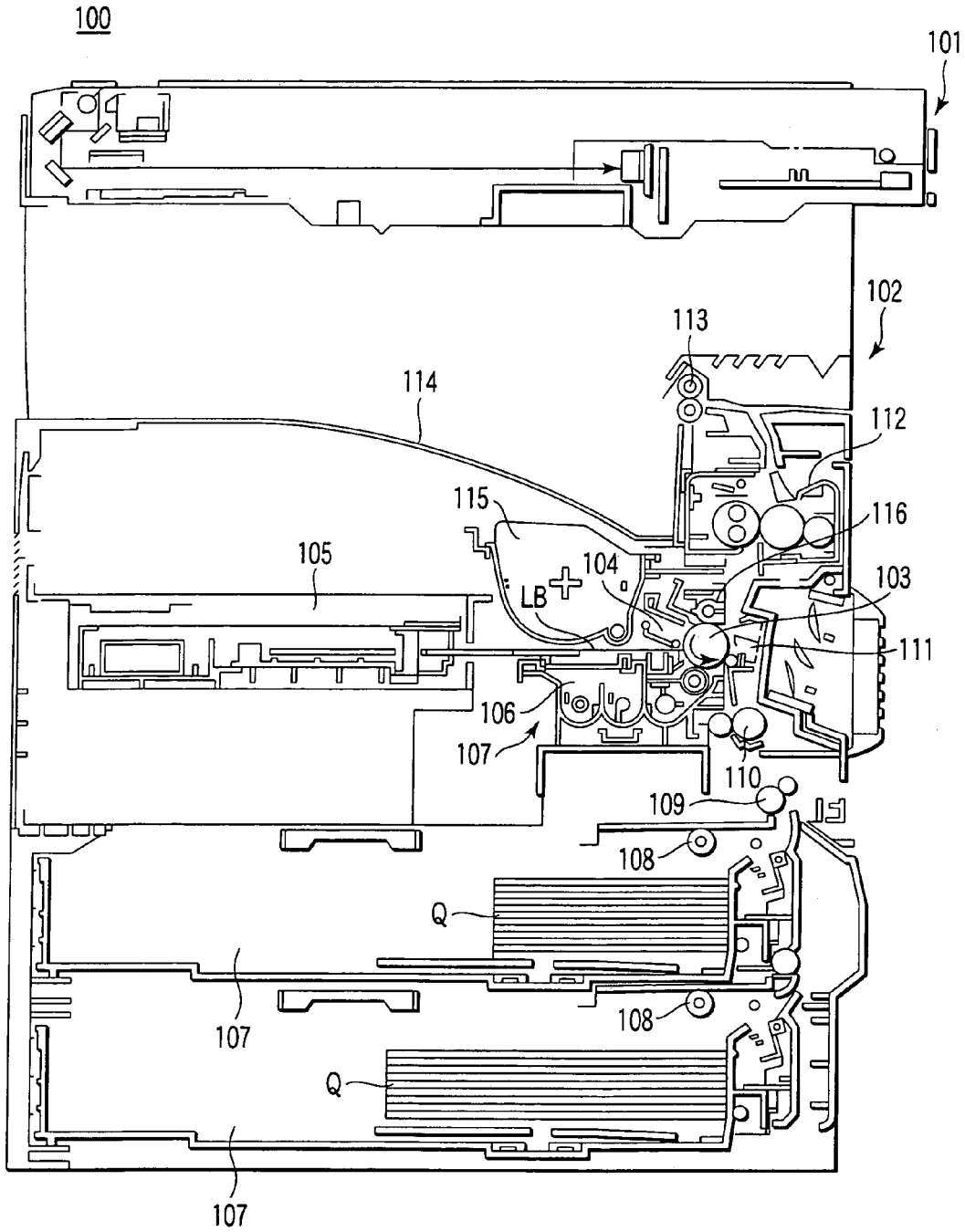
FIG. 1 is a schematic diagram explaining an image forming apparatus according to an embodiment of the present invention.

FIG. 1 schematically shows the front side of an image forming apparatus with a cover removed.

As shown in FIG. 1, an image forming apparatus (digital copier) 100 has an image reader (scanner) 101 which reads an image (original) to be read or copied and generates an image signal, and an image forming unit 102 which forms an image based on the image signal output from the scanner 101 or an image signal supplied from an external unit.

The image forming unit 102 has a photoconductive drum 103, a charger 104, an exposing unit 105, a developing unit 106, a paper cassette 107, a pickup roller 108, a conveying roller 109, an aligning roller 110, a transfer unit 111, a fixing unit 112, a paper ejecting roller 113, an ejected paper tray 114, a fresh toner supply unit 115, and a photoconductive drum cleaner 116.

The photoconductive drum (image carrier, image carrying means) 103 has a photoconductor on the circumference, which can hold an electrostatic image as a potential change for a predetermined time in an area that is electrified to a predetermined potential and irradiated in this state. The photoconductor may be like a belt as well as a drum.

The charger (charging means) 104 charges the surface of the photoconductive drum 103 to a predetermined potential. The charger 104 may be a corona wire, contact roller, or contact blade.

The exposing unit 105 is placed in the downstream side of the charger 104 in the rotating direction of the photoconductive drum 103, and exposes the photoconductive drum 103 to a laser beam LB whose intensity is changed corresponding to an image signal supplied from the scanner 101. The laser beam LB can have a predetermined intensity corresponding to the image density. The exposing unit 105 may use an LED instead of a laser beam.

The developing unit (developing means) 106 is placed in the downstream side of the exposing unit 105 in the rotating direction of the photoconductive drum 103, contains two-component developer consisting of carrier and toner, and supplies developer (toner) to the surface of the photoconductive drum 103. Thus, a latent image on the surface of the photoconductive drum 103 is developed, and a toner image is formed. The. developer may be one-component developer consisting of toner only.

The paper cassette 107 contains paper sheets Q. The pickup roller 108 picks up the paper sheets Q one by one. The paper sheet Q is fed to the aligning roller 110 by the conveying roller 109.

The aligning roller 110 rotates at a predetermined timing to match the position of the paper sheet Q to the toner image formed on the photoconductive drum 103, and feeds the paper sheet Q to a transfer position.

The transfer unit 111 gives the paper sheet Q a predetermined potential, and transfers the toner image on the photoconductive drum 103 to the paper sheet Q. The transfer unit 111 may be a corona wire, contact roller, or contact blade.

The fixing unit 112 gives predetermined heat and pressure to the paper sheet Q holding the toner image, and fixes the fused toner image to the paper sheet Q.

The paper ejecting roller 113 ejects the paper sheet Q from the fixing unit 112 to the ejected paper tray 114.

The fresh toner supply unit 115 supplies the developing unit 106 with fresh toner (unused developer) not used for image forming at a predetermined timing.

The photoconductive drum cleaner (collecting mechanism, collecting means) 116 is placed in the downstream side of the photoconductive drum 103 in the rotating direction of the photoconductive drum from the transfer position where the photoconductive drum 103 faces the transfer unit 111, and collects the toner adhered to the surface of the photoconductive drum 103. The photoconductive drum cleaner 116 includes a cleaning blade or a rotating brush, for example, which contacts the photoconductive drum 103.

The processing unit 117 is composed of a photoconductive drum 103, a charger 104, a developing unit 106, and a photoconductive drum cleaner 116. The processing unit 116 is removable from the image forming apparatus.

Figure 2:
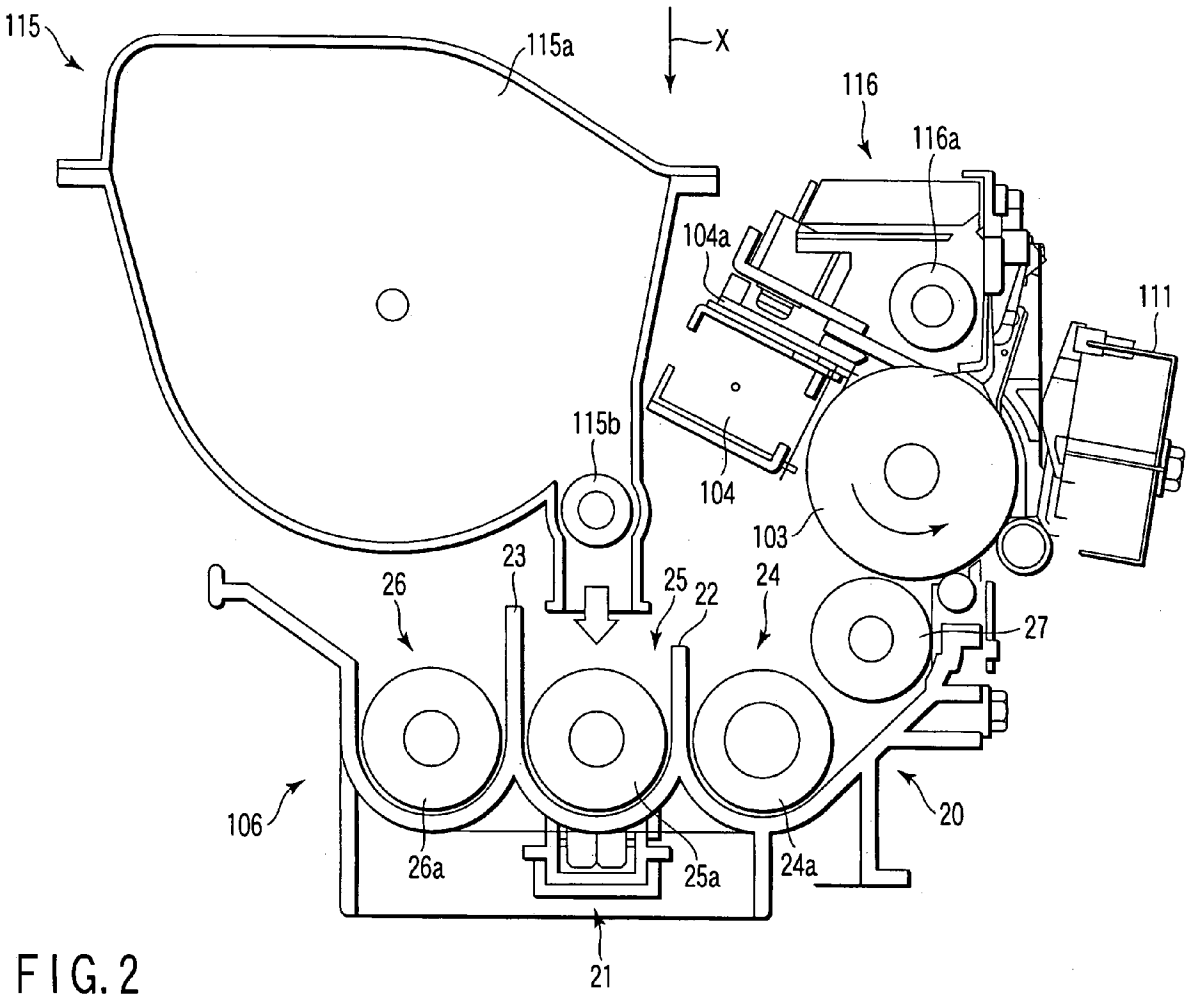
FIG. 2 is a schematic diagram of a developing unit and surrounding parts incorporated into the image forming apparatus shown in FIG. 1.
Figure 3:
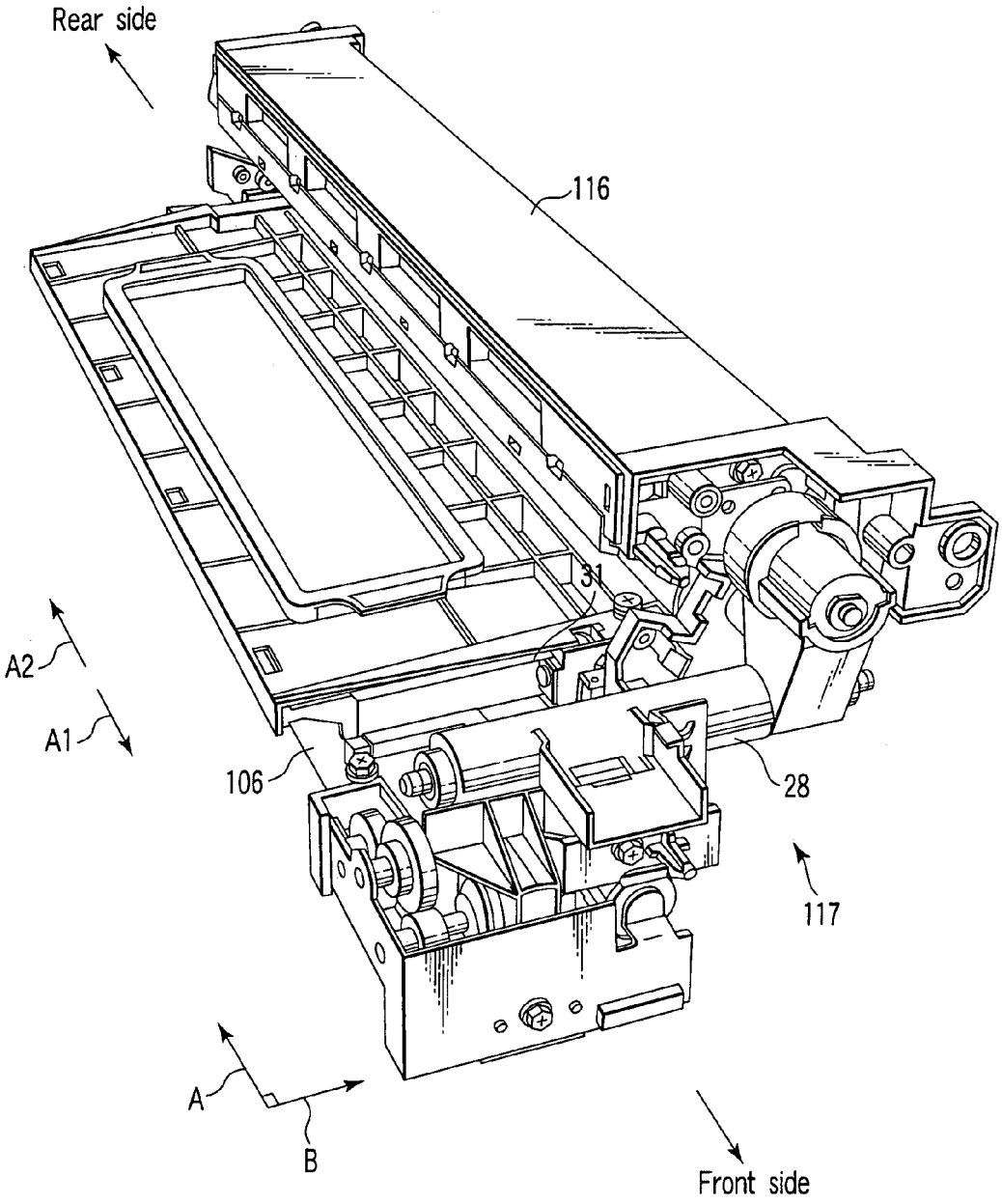
FIG. 3 is a schematic perspective view of the developing unit shown in FIG. 2.
Figure 4:
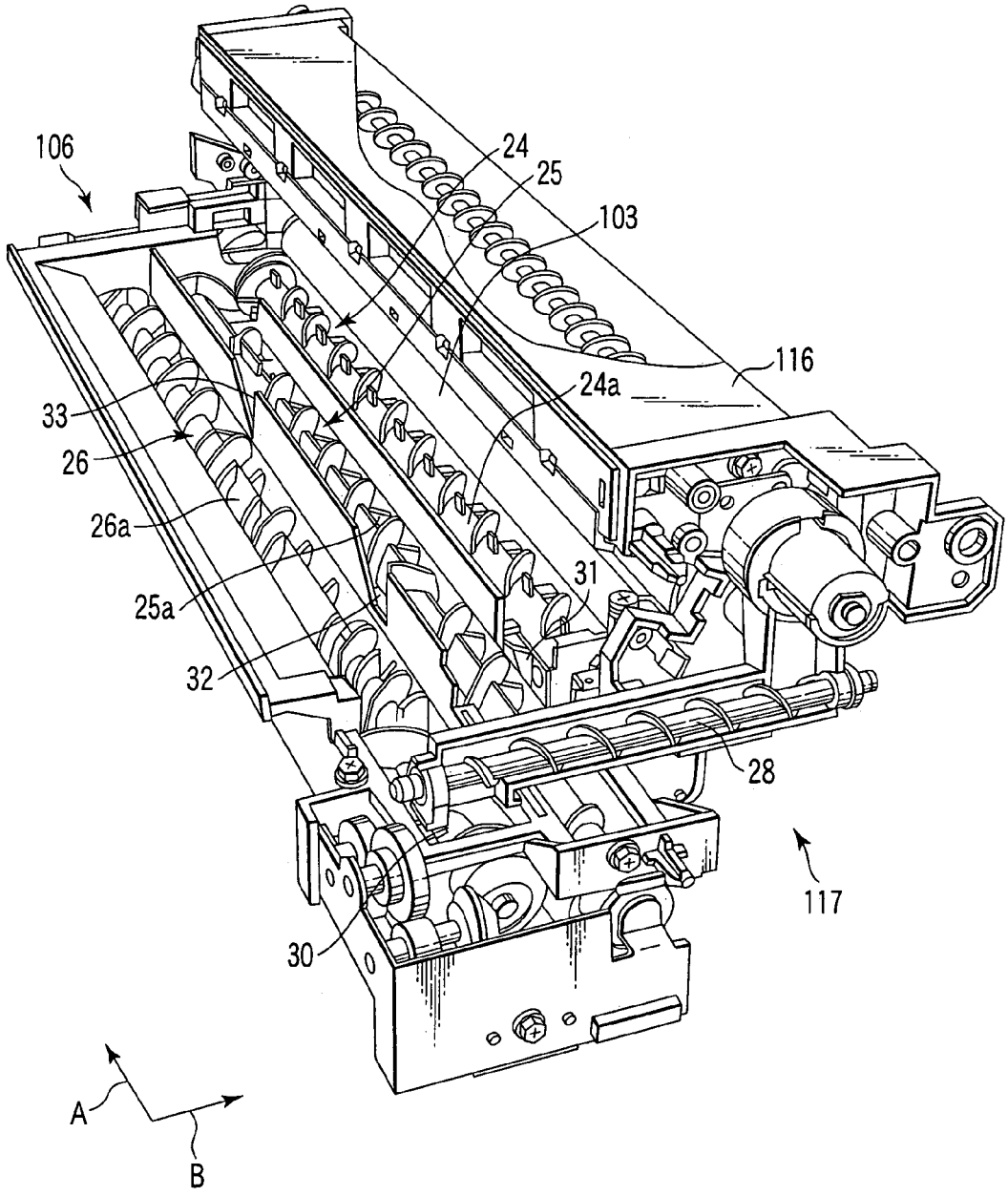
FIG. 4 is a schematic perspective view showing the inside of a cover of the developing unit shown in FIG. 3.
Figure 5:
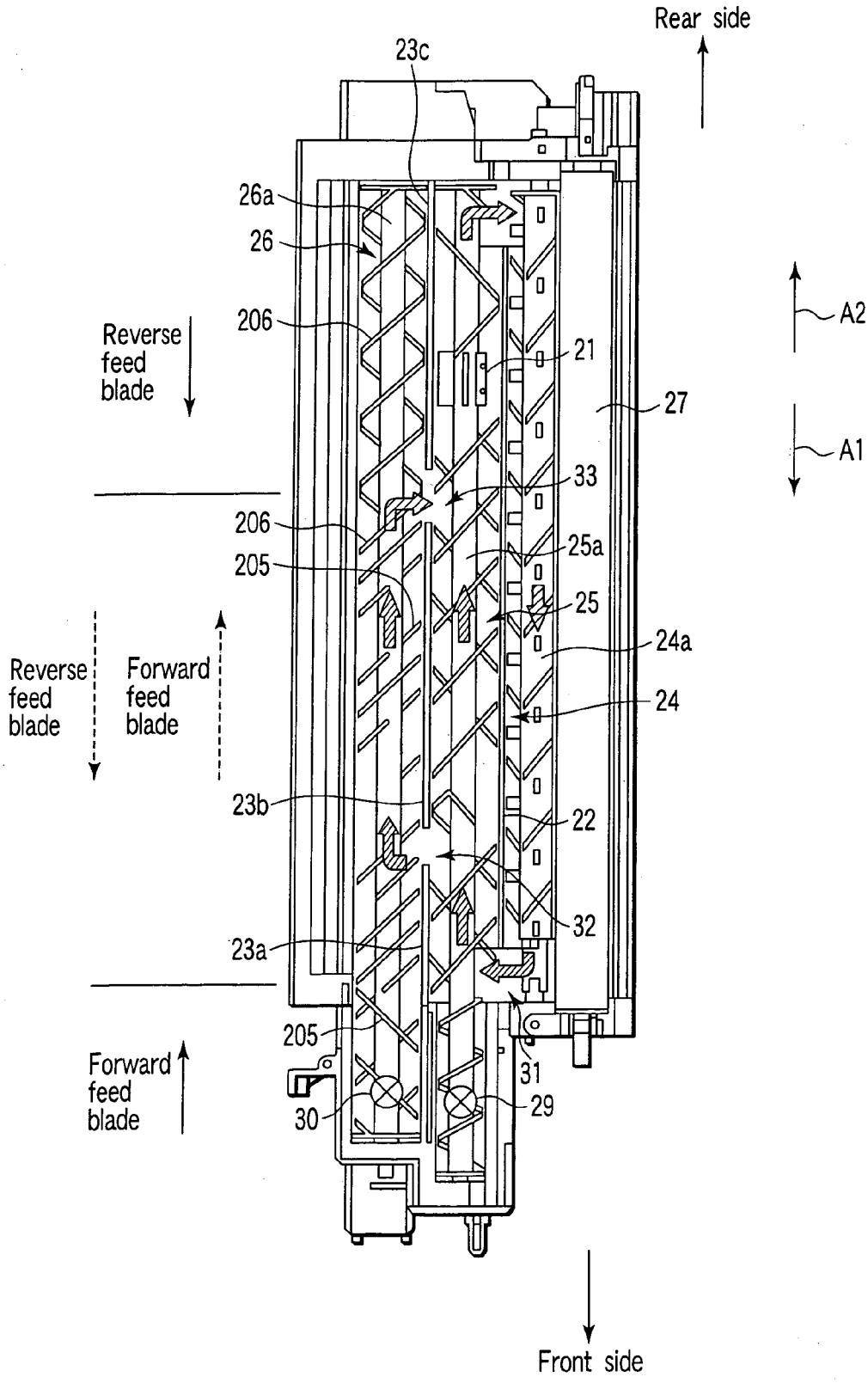
FIG. 5 is a schematic diagram explaining the operation of the developing unit shown in FIGS. 2 to 4.

FIG. 2 shows a schematic cross section at a predetermined front (side) position in the lengthwise direction of the developing unit, or the part in the vicinity of the end portion of a mixer. FIG. 3 shows a perspective view of the processing unit 117 including the developing unit 106 covered with a lid. FIG. 4 is a perspective view of the processing unit 117 shown in FIG. 3, with the cover removed. FIG. 5 is a schematic diagram of the developing unit 106 viewed from the arrow X shown in FIG. 2.

As shown in FIGS. 2 to 4, the developing unit 106 is placed under the fresh toner supply unit 115 and opposite to the photoconductive drum 103 at a predetermined position. The charger 104 and de-electrification lamp 104*a* are placed in the upstream side of the photoconductive drum 103 in rotating direction from the developing position opposite to the developing unit, and the transfer unit 111 and photoconductive drum cleaner 116 are sequentially placed in the downstream side.

The fresh toner supply unit 115 has a fresh toner cartridge 115*a* containing fresh toner, and a supplying roller 115*b* which is rotated at a predetermined timing to supply fresh toner to a predetermined position of a second chamber 25. The fresh toner cartridge 115*a* is removable from the image forming apparatus.

The photoconductive drum cleaner 116 is placed above the developing unit 106, and includes a recycled toner conveying roller 116*a* to convey the collected recycled toner (used developer) to the front side.

The developing unit 106 includes a developing container (developer container) 20 to contain two-component developer (hereinafter called a developer) consisting of carrier and toner, and a magnetic sensor 21 to detect the toner density contained in the developing container 20. The magnetic sensor 21 is preferably placed at a predetermined position under the developing container 20.

The developing container 20 includes a first chamber (first developer containing means) 24 to contain developer, a second chamber (second developer containing means) 25, and a third chamber (third developer containing means) 26.

As shown in FIGS. 4 and 5, the first chamber 24 has a first mixer (first stirring means) 24*a* having an axis parallel to the axial direction A of the photoconductive drum 103, conveys developer in a first direction, stirs carrier and toner, and gives the toner a predetermined potential. The toner is supplied to the developing position of the photoconductive drum 104 by a developing roller (developer carrying member) 27 provided rotatably.

The first mixer 24*a* is rotated to stir and convey the developer in the first chamber 24 at a first speed from the rear side to the front side, namely in a first direction A1. In other words, the first mixer 24*a* stirs and conveys the developer received from a second mixer 25*a* described later, supplies the developer to the developing roller 27, and receives and conveys the developer removed from the developing roller after development.

The second chamber 25 has a second mixer (second stirring means) 25*a* having an axis parallel to the axial direction A, conveys developer in a second direction (forward direction) A2 different from the first direction, stirs carrier and toner, and gives the toner a predetermined potential. The second chamber 25 is parted from the first chamber 24 by a first partition 22. The first partition 22 has a predetermined length to connect the first and second chambers 24 and 25 in the rear and front sides. In the upstream side (front side) of the second chamber 25, a first connecting part 31 is provided to connect to the downstream side of the first chamber 24.

The second mixer 25*a* is rotated to stir and convey the developer in the second chamber 25 at the first speed the same as the first mixer 24*a* from the front side to the rear side, namely in a second direction A1. At the end portion of the front side of the second mixer 25*a*, a fresh toner supply unit (unused developer supply unit) 29 is provided to supply fresh toner from a fresh toner supply unit 115. Namely, the second mixer 25*a* stirs and conveys the developer received from the first mixer 24*a*, conveys the fresh toner received from the fresh toner supply unit 115 while mixing it with the developer, and supplies the developer to the first mixer 24*a*.

The third chamber 26 has a third mixer (third stirring means) 26*a* having an axis parallel to the axial direction A, conveys developer in the second direction A2, stirs carrier and toner, and gives the toner a predetermined potential. The third chamber 26 is parted from the second chamber 25 by second partitions 23*a*, 23*b* and 23*c*. The partition 23*a* separates the first connecting part 31 located on the front side of the second chamber 24 from the third chamber 26, and the partition 23*c* separates the rear side of the second chamber from the rear side of the third chamber 26. The partition 23*b* separates the second chamber 25 from the third chamber 26 between the second connecting part 32 and third connecting part 33. Namely, the third chamber 26 is connected to the second chamber 25 in the second connecting part 32 downstream of the first connecting part 31 of the second chamber, and further connected to the second chamber 25 in the third connecting part 33 in the downstream side of the middle of the second chamber 25. On the front side of the third chamber 26, a recycled toner supply unit (used developer supply unit) 30 is provided to supply the recycled toner collected from the surface of the photoconductive drum 103 through the photoconductive drum cleaner 116.

As explained later with reference to FIG. 6, the third mixer 26*a* has a forward feed blade that is rotated in a predetermined direction to feed developer in a forward direction (from the front side to the rear side) A2, and a reverse feed blade that feeds developer in the direction reverse to the forward direction (from the rear side to the front side) A1. The third mixer is configured to stir sufficiently the developer in the third chamber 26. Namely, the third mixer 26*a* feeds the developer received from the second connecting part 32 to the rear side, and returns the developer to the front side, stirs it sufficiently, and ejects it from the third connecting part 33 to the second chamber 25. Therefore, the third mixer 26*a* can feed the developer in the third chamber 26 in the second direction A2 while stirring it at the second speed slower than the first speed.

Between the recycled toner supply unit 30 and photoconductive drum cleaner 116, a recycled toner supply mechanism (used developer supply mechanism) 28 is provided to supply the recycled toner supplied from the photoconductive drum cleaner 116 to the recycled toner supply unit 30 on the front side of the third chamber 26.

The recycled toner supply mechanism 28 is a mixer, which has spiral blades and an axis in a direction B arranged in a predetermined direction with respect to the axial direction A of the photoconductive drum 103, for example, and can feed recycled toner by rotation. The recycled toner from the recycled toner supply mechanism 28 is supplied to the recycled toner supply unit 30 located on the front side of the third chamber 26.

Now, explanation will be given on the operation of the image forming apparatus 100 configured as described above. In this embodiment, image forming by reversal development will be explained.

When image forming is instructed, the scanner 101 starts reading an image and the image forming unit 102 discharges the charger 104. The photoconductive drum 103 charged negatively and evenly by the charger 104 is irradiated by the exposing unit 105. The part irradiated by the exposing unit 105 becomes close to zero potential. Namely, a latent image is formed on the surface of the photoconductive drum 103. The latent image part on the surface of the photoconductive drum 103 attracts the negatively charged toner by the developing unit 106, and forms a toner image. The toner image is conveyed to a transfer position by the aligning roller 110, and transferred to a paper sheet Q charged positively by the transfer unit 111. The toner image transferred to the paper sheet Q is fused and fixed by the fixing unit 112. Namely, an image is formed on the paper sheet Q. The paper sheet Q with the image formed by the fixing unit 112 is ejected to the eject tray 114 by the ejecting roller 113.

In contrast, the toner not transferred from the surface of the photoconductive drum 103 to the paper sheet Q and having reached the photoconductive drum cleaner 116 is collected by the photoconductive drum cleaner 116.

The collected recycled toner is gathered on the front side by the collected toner conveying roller 116*a*, and ejected from the toner eject port 116*b*. The recycled toner ejected from the toner eject port 116*b* is supplied to the recycled toner supply unit 30 through the recycled toner supply mechanism 28, and reused as recycled toner. If a decrease of the toner density in the developing container 20 is detected by the magnetic sensor 21, fresh toner is supplied to the fresh toner supply unit 29.

If the toner density detected by the magnetic sensor 21 is not increased even if fresh toner is supplied by operating the supplying roller 115*b*, a specified display unit (e.g., a control panel) displays that the fresh toner in the fresh toner cartridge 115*a* has been used up, and notifies the user of the end of toner.

Next, the third mixer 26*a* will be explained in detail with reference to FIGS. 6 and 7. FIG. 6 is a schematic perspective view of the third mixer 26*a*. FIG. 7 is a schematic diagram of the third mixer 26*a*viewed from the top.

Figure 6:
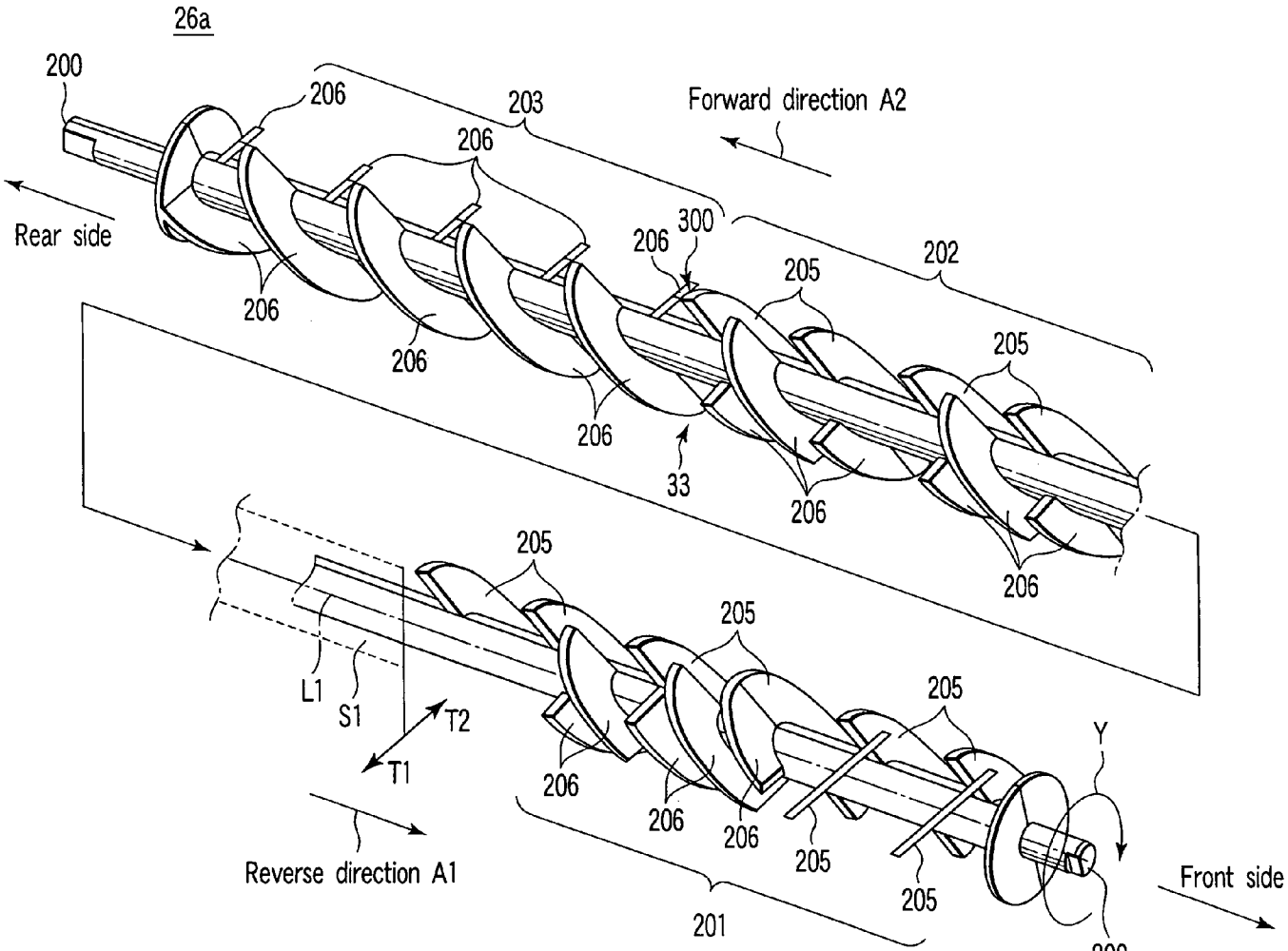
FIG. 6 is a schematic perspective view of the mixer shown in FIG. 5.
Figure 7:
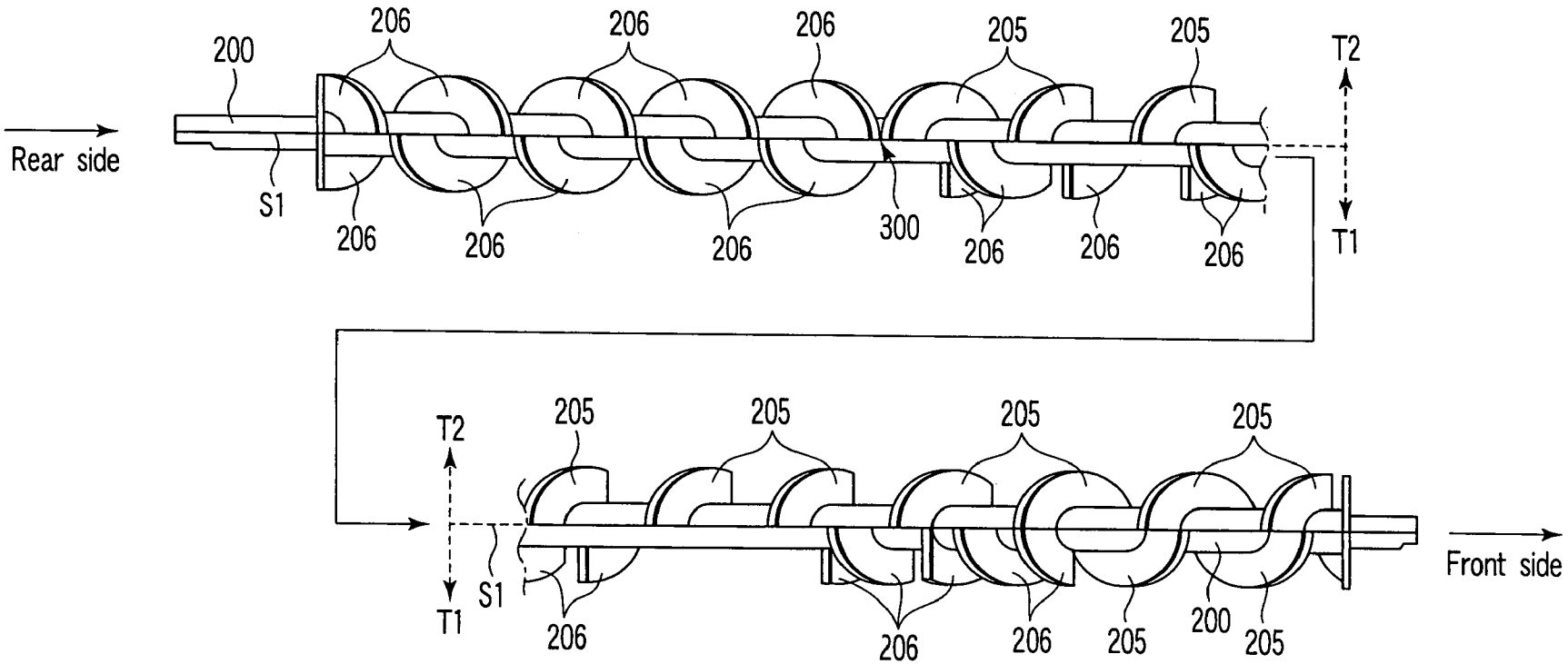
FIG. 7 is a schematic diagram of the mixer shown in FIG. 6, viewed from the top.

As shown in FIGS. 6 and 7, the third mixer 26*a* includes a rotary shaft (rotary shaft member) 200. The third mixer 26*a* includes, in the axial direction of the rotary shaft 200, a first mixer 201 located between the recycled toner supply unit 30 and second connecting part 32, a second mixer 202 located between the second connecting part 32 and third connecting part 33, and a third mixer 203 located between the third connecting part 33 and the end portion of the rear side.

The first mixer 201 has forward feed blades 205 that are rotated in a predetermined direction Y to feed developer in a forward direction A2, and reverse feed blades 206 that feed developer in a direction reverse to the forward direction (from the rear side to the front side). The second mixer 202 has forward feed blades 205 and reverse feed blades 206. The third mixer 203 has reverse feed blades 206. The forward feed blades 205 and reverse feed blades 206 are semi-elliptical blades divided into halves on the virtual boundary surface S1 passing through the center line L1 of the rotary shaft 200, and inclined a predetermined angle to the rotary shaft 200. The forward feed blades 205 and reverse feed blades 206 are inclined at different angles to the rotary shaft 200, just like the third mixer 26*a* is rotated in the rotating direction Y to feed developer in the reverse direction.

The semi-elliptical forward feed blades 205 and reverse feed blades 206 are formed corresponding to first area T1 and second area T2 divided on the virtual boundary surface S1. Namely, the first mixer 201 has the forward feed blades 205 in the first and second areas T1 and T2, and the reverse feed blades 206 in the first area T1. The second mixer 202 has the reverse feed blades 206 in the first area T1, and the forward feed blades 205 in the second area T2. The third mixer 203 has the reverse feed blades 206 in the first and second areas T1 and T2.

In other words, as shown in FIG. 5, the third mixer 26*a* has only the forward feed blades 205 on the front side, only the reverse feed blades 206 on the rear side, and both forward feed blades 205 and reverse feed blades 206 in the middle part.

Further, as shown in FIG. 6, a paper dust collector 300 is formed between the second mixer 202 and third mixer 203.

The paper dust collector 300 is formed in the part of the second area T2 where the front ends of the forward feed blades 205 and reverse feed blades 206 facing each other in the axial direction are close to each other. Explained in detail, the paper dust collector 300 is formed in the part where the ends of the forward blade feeds 205 and reverse feed blades 206 become close to each other on the rear side of the rotating direction of the rotary shaft 200 when the rotary shaft 200 is rotated in the direction Y. Thus, when developer is stirred by the third mixer 26*a*, the developer is fed by both forward and reverse blades 205 and 206 toward the front ends of the blades positioned close to each other, and collected in the paper dust collector 300. In this time, paper dust larger than the developer (impurity b) is caught and collected by the paper dust collector 300 that is the front end of the blades positioned close to each other. Since the developer is finer than paper dust and the front ends of the forward and reverse blades 205 and 206 are positioned close to each other, the developer is pushed out by the forward and reverse blades 205 and 206 without being caught by the paper dust collector 300.

Therefore, the paper dust collector 300 configured as described above can collect paper dust without interrupting the flow of developer. This prevents stains and white stripes, so-called paper dust fog, caused by the paper dust, or a lump of paper dust being conveyed from the developing unit 106 to the photoconductive drum 103, and realizes stable good image forming. Further, the paper dust that is the impurities included in the developer contained in the developer container 20 can be collected, and the developer fed while being stirred in the developer container 20 is prevented from being damaged by the paper dust. This extends the life of the developer.

Further, as shown in FIG. 8, the paper dust collector 300 forms a gap G1 of predetermined magnitude between the forward feed blade 205 and reverse feed blade 206. As long as the gap G1 of the paper dust collector 300 is in a range of 0-0.25 mm as shown in FIG. 9, a good image can be formed. FIG. 10 shows the paper dust collector 300 with a gap G1 of zero. If the gap G1 exceeds the above range, paper dust is fed through the forward feed blade 205 and reverse feed blade 206 and cannot be collected, causing defective image forming.

"Paper Dust Save" shown in FIG. 9 indicates the ratio of paper dust amount assuming that the paper dust amount saved in unit time is 1, when the gap G1 is zero or when the forward feed blade 205 contacts the reverse feed blade 206. "Dust Fog Paper Number" indicates the number of paper sheets Q passed continuously through the photoconductive drum 103 during the period from the supply of dust or a lump of paper dust from the developing unit 106 to the photoconductive drum 103, to the generation of stains and white stripes, so-called paper dust fog.

By setting the gap G1 of the paper dust collector 300 between the forward feed blade 205 and reverse feed blade 206 to 0-0.25 mm as described above, paper dust can be collected without interrupting the flow of developer. As the paper dust collector is formed in the part close to the forward feed blade 205 and reverse feed blade 206, the manufacturing cost can be reduced.

As shown in FIG. 8, the paper dust collector may be configured to have an auxiliary paper dust collection member 400 such as a mesh between the forward feed blade 205 and reverse feed blade 206. This increases the effect of collecting paper dust.

In the above configuration, the third mixer 26*a* can stir and feed the developer fed from the second connecting part 32 to the third chamber 26 by rotating the forward feed blade 206, after once feeding the developer in the reverse direction or toward the recycled toner supply unit 30 (front side) by rotating the reverse feed blade 205.

Further, as shown in FIG. 6, the third mixer 26*a* can feed developer at a predetermined speed according to the ratio of total area of the forward feed blade 205 to the reverse feed blade 206. When changing the feed speed minutely, the area of each blade may be changed. For example, the forward feed blade 205 may be changed to ½ or ⅔. Thus, the stirring amount of the developer in the third chamber 26 can be increased to larger than the stirring amount of the developer in the first and second chambers, with the third speed decreased to ½, ⅓ and ⅙ of the first and second speeds, for example. Therefore, the stirring amount of the recycled toner fed in the third chamber 26 can be increased to more than the stirring amount of fresh toner. This can reduce the charging level difference between the fresh toner and recycled toner.

In this embodiment, the two-component developer in the developing container 20 is preferably composed of carrier of about 95% (mass) and toner of 5% (mass). This ratio of carrier to toner is detected by the magnetic sensor 21, and toner is replenished by the fresh toner supply unit 115 according to the detection results.

The present invention is not limited to the embodiments described hereinbefore. The invention may be embodied in other specific forms by modifying the components without departing its spirit or essential characteristics. The invention may be embodied in various forms by combining the components disclosed in the above embodiments. For example, some components may be deleted from the components of the embodiments. The components of different embodiments may be combined. For example, the paper dust collector 300 has been explained to be provided in the third mixer 26*a*. But, the collector is not limited to this. The collector may be provided in the first mixer 24*a* or second mixer 26*a*. Two or more collectors may be provided in at least one of the mixers.

What is claimed is:

1. A developing unit comprising:

a developer container to contain developer;

a mixer which includes a rotary shaft member held rotatably at a predetermined position of the developer container, first feed blades formed at predetermined positions of the rotary shaft member to feed the developer in a first direction, and second feed blades formed at predetermined positions of the rotary shaft member to feed the developer in a direction different from the first direction;

an impurity collector which is formed between the first feed blades and second feed blades faced to each other in the axial direction of the rotary shaft member, and collects impurities mixed in the developer fed by the first feed blades and second feed blades; and an auxiliary collecting member which is provided in a gap between the first feed blades and second feed blades in the impurity collector.

2. The developing unit according to claim 1, wherein the impurity collector has a gap of 0-0.25 mm between the first feed blades and second feed blades.

3. The developing unit according to claim 1, wherein the auxiliary collecting member is a mesh member.

4. The developing unit according to claim 1, further comprising:

an unused developer supply unit which is provided in an upstream side of the second chamber, and supplies unused developer; and a used developer supply unit which is provided in an upstream side of the third chamber, and supplies used developer;

wherein the developer container includes a first chamber having a first mixer to stir and feed developer in a first direction, a second chamber having a second mixer to stir and feed the developer supplied from the first chamber in a second direction different from the first direction, and a third chamber having a third mixer to stir and feed the developer supplied from the second chamber in the second direction; and the impurity collector is formed in the third mixer.

5. The developing unit according to claim 1, further comprising a developer carrying member which carries developer for supplying developer to an image carrier; and the developing unit is removable as a unit from an image forming apparatus.

6. The developing unit according to claim 5, wherein the image carrier is held integrally as a processing unit.

7. An image forming apparatus comprising:

an image carrier to hold electrostatically a developer image formed by developer;

a developer container to contain developer;

a mixer which includes a rotary shaft member held rotatably at a predetermined position of the developer container, first feed blades formed at predetermined positions of the rotary shaft member to feed the developer in a first direction, and second feed blades formed at predetermined positions of the rotary shaft member to feed the developer in a direction different from the first direction;

an impurity collector which is formed between the first feed blades and second feed blades faced to each other in the axial direction of the rotary shaft member, and collects impurities mixed in the developer fed by the first feed blades and second feed blades; and an auxiliary collecting member which is provided in a gap between the first feed blades and second feed blades in the impurity collector.

8. The image forming apparatus according to claim 7, wherein the impurity collector has a gap of 0-0.25 mm between the first feed blades and second feed blades.

9. The image forming apparatus according to claim 7, wherein the auxiliary collecting member is a mesh member.

10. The image forming apparatus according to claim 7, further comprising:

an unused developer supply unit which is provided in an upstream side of the second chamber, and supplies unused developer; and a used developer supply unit which is provided in an upstream side of the third chamber, and supplies the used developer collected from the surface of the image carrier;

wherein the developer container includes a first chamber having a first mixer to stir and feed developer in a first direction to supply to the image carrier, a second chamber having a second mixer to stir and feed the developer supplied from the first chamber in a second direction different from the first direction, and a third chamber having a third mixer to stir and feed the developer supplied from the second chamber in the second direction; and the impurity collector is formed in the third mixer.

11. The image forming apparatus according to claim 7, further comprising:

a charger to charge the surface of the image carrier to a predetermined potential;

a collecting mechanism to eject the used developer collected from the image carrier to the used developer supply unit; and a processing unit which includes at least one of the image carrier, developing unit, charger and collecting mechanism, and is removable from the image forming apparatus.

12. An image forming apparatus comprising:

image carrying means for carrying electrostatically a developer image formed by developer;

developer containing means containing developer;

stirring means for stirring the developer, the stirring means having a rotary shaft member held rotatably at a predetermined position of the developer containing means, first feed blades formed at predetermined positions of the rotary shaft member to feed the developer in a first direction, and second feed blades formed at predetermined positions of the rotary shaft member to feed the developer in a direction different from the first direction;

impurity collecting means which is formed between the first feed blade and second feed blade faced to each other in the axial direction of the rotary shaft member, for collecting impurities mixed in the developer fed by the first feed blade and second feed blade; and an auxiliary collecting member which is provided in a gap between the first feed blades and second feed blades in the impurity collecting means.

13. The image forming apparatus according to claim 12, wherein the impurity collecting means has a gap of 0-0.25 mm between the first feed blades and second feed blades.

14. The image forming apparatus according to claim 12, wherein the auxiliary collecting member is a mesh member.

15. The image forming apparatus according to claim 12, further comprising:

an unused developer supply unit which is provided in an upstream side of the second developer containing means, and supplies unused developer; and a used developer supply unit which is provided in an upstream side of the third developer containing means, and supplies the used developer collected from the surface of the image carrying means;

wherein the developer containing means includes a first developer containing means having a first stirring means to stir and feed developer in a first direction to supply to the image carrying means, a second developer containing means having a second stirring means to stir and feed the developer supplied from the first developer containing means in a second direction different from the first direction, and a third developer containing means having a third stirring means to stir and feed the developer supplied from the second developer containing means in the second direction; and the impurity collecting means is formed in the third stirring means.

16. The image forming apparatus according to claim 12, further comprising:

charging means to charge the surface of the image carrying means to a predetermined potential;

collecting means to eject the used developer collected from the image carrying means to the used developer supply unit; and a processing unit which includes at least one of the image carrying means, developing means, charging means and collecting means, and is removable from the image forming apparatus.

* * * * *